United States Patent [19]

Doran et al.

[11] Patent Number: 4,809,977

[45] Date of Patent: Mar. 7, 1989

[54] GOLF CLUB SET WITH ALIGNMENT FEATURES

[75] Inventors: Brian A. Doran, Solvang, Calif.; Robert H. Redkey, 1630 Maple, Solvang, Calif. 93463

[73] Assignee: Robert H. Redkey, Solvang, Calif.

[21] Appl. No.: 66,726

[22] Filed: Jun. 25, 1987

[51] Int. Cl.[4] ..... A63B 53/04

[52] U.S. Cl. ..... 273/77 A; 273/171; 273/164

[58] Field of Search ..... 273/77 A, 171, 164, 273/163 R, 163 A, 167 C, 175, 77 R, 167 D, 167 E, 167 F, 167 H, 183 D; D21/219, 220

[56] References Cited

U.S. PATENT DOCUMENTS

| | | | |
|---|---|---|---|
| D. 230,615 | 3/1974 | Delgadillo | D21/2 |
| D. 241,563 | 9/1976 | McCord | D21/2 |
| 2,517,245 | 8/1950 | Scott | 273/171 |
| 3,343,839 | 9/1967 | Borah | 273/80.2 |
| 3,884,477 | 5/1975 | Bianco | 273/183 D |
| 4,030,766 | 6/1977 | Derr | 273/163 R |
| 4,213,613 | 7/1980 | Nygren | 273/171 |

FOREIGN PATENT DOCUMENTS

| | | | |
|---|---|---|---|
| 800486 | 12/1968 | Canada | 273/164 |
| 598473 | 2/1948 | United Kingdom | 273/77 A |

*Primary Examiner*—George J. Marlo
*Attorney, Agent, or Firm*—Price, Gess & Ubell

[57] ABSTRACT

A golf club set wherein each club employs an alignment ball section integrally formed therewith and having heel and toe weights mounted therein to improve the club stroke. The preferred putter further includes second heel and toe weights at the end of the putter blade, providing a dual weighting system. The woods according to the preferred embodiment employ a ball section mounted in a recess in the top surface thereof while the irons and putter have the ball section centrally located behind the blade.

12 Claims, 4 Drawing Sheets

GOLF CLUB SET WITH ALIGNMENT FEATURES

BACKGROUND OF THE INVENTION

1. Field of the Invention

The subject invention relates to golf clubs and more particuarly to golf clubs with alignment features.

In the prior art, various alignment features have been suggested, primarily for use with putters. It has also been suggested to provide a circle of the precise diameter of a golf ball on the top surface of a wood as in U.S. Pat. No. 3,884,447.

No prior art has suggested alignment means for use with an entire line of clubs or an alignment mechanism adaptable throughout a club line.

One of the important features impacting on club alignment and proper striking of the golf ball is the "sweetpot" which surrounds the center of gravity of the club. The prior art has generally failed to integrate alignment means with the positioning of the center of gravity of the club. In general, prior art devices have not entirely eliminatd guess work and inaccuracy in club alignment, nor provided an alignment technique and apparatus usable throughout a club line.

SUMMARY OF THE INVENTION

It is therefore an object of the invention to provide improved alignment apparatus for aligning golf clubs with the ball;

It is a further object of the invention to provide an alignment approach usable throughout a club line and a club line employing this approach;

It is another object of the invention to provide an alignment approach which integrates the alignment mechanism with the center of gravity of the club;

It is another object of the invention to provide an improved alignment mechanism for woods;

It is another object of the invention to provide an alignment mechanism for irons; and It is yet another object of the invention to provide an improved weighting system which may be integrated with the improved alignment mechanism.

These and other objects of the invention are achieved by providing a set of golf clubs employing ball segments positioned behind the club face for alignment with the golf ball. The club face itself has a circle thereon which represents the face of the ball section were the section continued through the club face. Weighting is provided in the ball segment to locate the center of gravity and to concentrate the weight of the club head about the center of gravity in order to increase the ease with which a proper stroke may be made with the club.

BRIEF DESCRIPTION OF THE DRAWINGS

The just-summarized invention will now be described in conjunction with the drawings of which.

DETAILED DESCRIPTION OF THE PREFERRED EMBODIMENT

Figure 1:
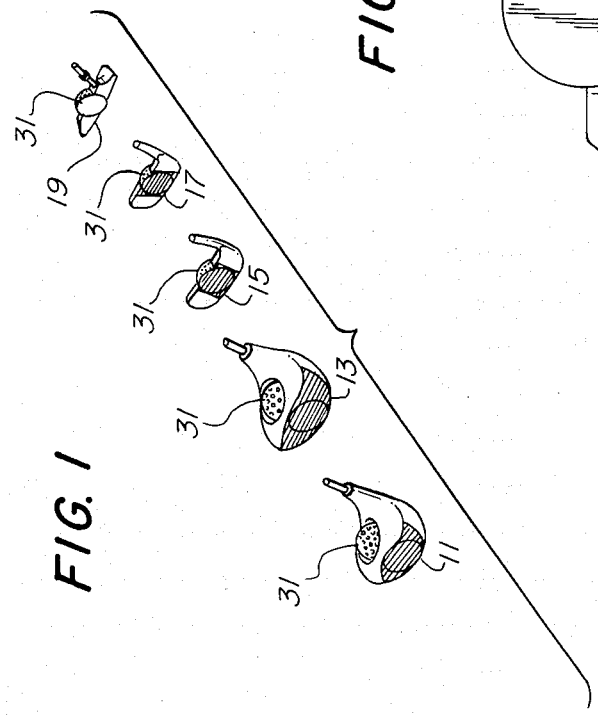
FIG. 1 is a perspective view of a club set in accordance with the preferred embodiment.
Figure 7:
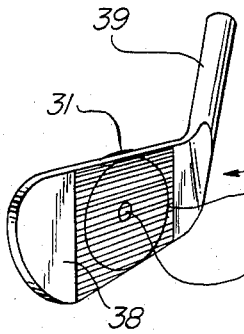
FIG. 7 is a perspective view of an iron according to the preferred embodiment.

FIG. 1 illustrates a golf club set wherein each club 11, 13, 15, 17, 19 employs a ball alignment mechanism including a ball section 31. FIGS. 2–8 illustrate in detail a putter 33 in the golf club line. FIGS. 9–13 illustrate a typical iron 35 and FIGS. 14–20 illustrate a typical wood 37.

The putter 33 includes a blade 34 integrally formed with a centrally located ball section 31 and a shaft segment 35. The putter 33 employs a dual weighting system as hereafter described.

Figure 8:
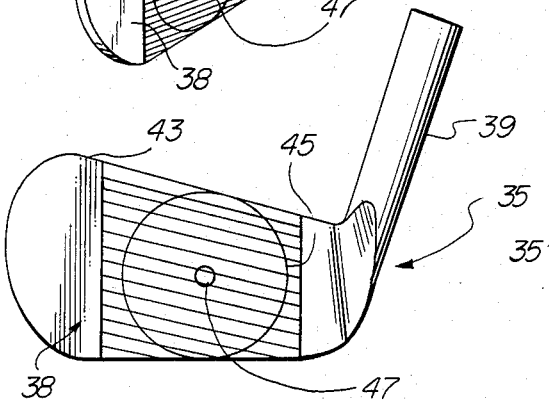
FIG. 8 is a front elevational view of the iron of FIG. 7.
Figure 9:
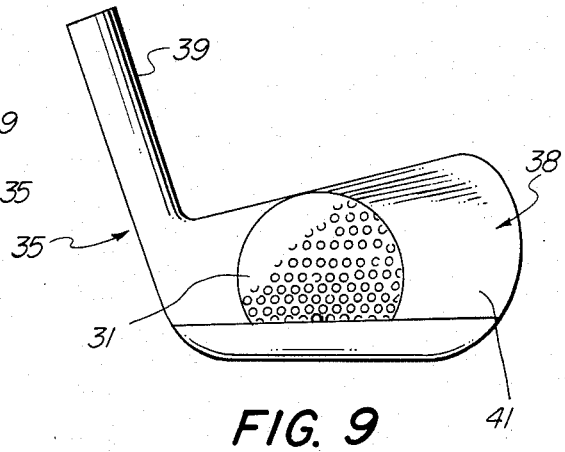
FIG. 9 is a rear elevational view of the iron of FIG. 7.

The iron 35 of FIGS. 9–13 also includes a blade 38, a ball section 31, and a shaft segment 39 which are integrally formed, as will be further described. Each iron of the club set includes such integrally formed elements 31, 38, 39 with varying lofts as in a typical standard club set. As shown, the ball section 31 of the preferred iron 35 appears integrally formed with the heel of the iron 35. The ball section 31 further is applied entirely to the rear surface 41 of the blade 38 so that the ball section 31 does not appear above the top edge 43 of the blade 38, as shown in FIG. 8. Again, a circle 45 of the diameter of the ball is formed on the iron face, as if the ball section 31 cut through the iron blade 38. A dot 47 locates the center of gravity on the club face.

The preferred embodiment wood 37 (FIGS. 14–20) includes an integrally formed shaft 52, a club head 53, and a ball section 31. The wood 37 is generally similar in shape, loft, and other club parameters to a typical golf club wood. A distinguishing difference of the wood of FIGS. 14–20 over the conventional wood is the recessed ball section 31. As shown, the recess 51 containing the ball section 31 appears tear-dropped in shape in the top view of FIG. 17. This shape provides the rear "v" 54 shown in FIG. 17, which contributes to the aerodynamics of the swing. On the wood face 55, a circle 57 is imprinted or otherwise indicated. The circle 57 has the same diameter as the diameter of the sphere from which the ball section 31 is formed, which, as previously indicated, is 1.68 inches. The recess 51 is of such a depth that the circle 57 is a projection of the periphery of the sphere which includes the ball section 31 onto the face 55 of the wood 37. The recessed ball section 31 of the wood 37 has the advantage of giving the player the feeling of being able to sweep the ball off the ground.

Figure 21:
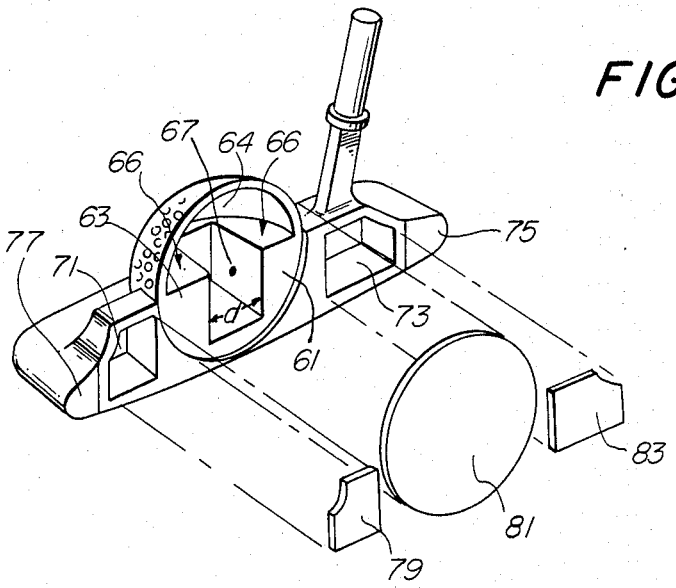
FIG. 21 is a perspective illustrating weighting in a putter according to the preferred embodiment.

FIG. 21 illustrates the perimeter weighting feature of the preferred golf club set. According to this feature, a toe weight 63 and a heel weight 61 are provided within the generally hollow interior 64 of the ball section 31. The heel weight 61 and toe weight 63 are mirror images of one another and of equal weight. They are formed of the same material as the ball section 31 and have a flat top surface 66 coincident with a horizontal plane bisecting the ball section 31. The distance "d" between the weights 61, 63 is varied to determine the amount of weighting desired, e.g. from ½ to 3 ounces on each side. The resulting center of gravity 67 lies just below the geometric center of the ball section 31.

On either side of the ball section 31, hollow spaces 71, 73 are formed in the putter blade 34. On either side of the hollow spaces 71, 73 in the putter blade 34, respective heel and toe weights 75, 77 are effectively provided by solid areas of material. The heel and toe weights 75, 77 are equal in weight. Thus, a dual heel and toe weighting system is provided by the heel weights 61, 75, and the toe weights 63, 77. The putter blade 34 is closed by face plates 79, 81, 83, which are attached to the putter blade as hereafter described.

Figure 22:
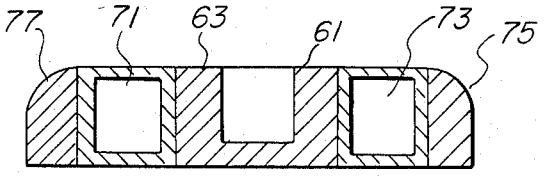
FIG. 22 is a bottom view of the putter of FIG. 21 further illustrating the distribution of hollow and weighted areas.

The section of FIG. 22 shows the distribution of hollow areas 71, 73 and weighted areas 61, 63, 75, 77 in the putter of FIG. 21 to further illustrate the general weighting approach.

Figure 23:
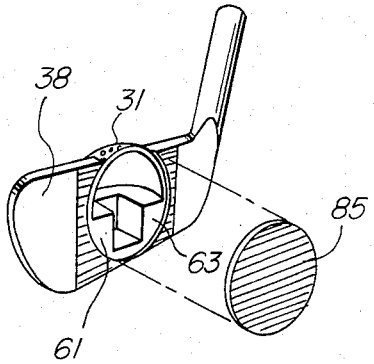
FIG. 23 is a perspective illustrating weighting in a typical iron in the club set.

FIG. 23 illustrates weighting within the ball section 31 of a typical iron 35 in the club set. The iron 35 employs heel and toe weights 61, 63 within the perimeter of the golf ball section 31. The club face 38 is again closed by a face plate 85 as in FIG. 21. As with the putter. However, dual weighting is not incorporated.

Figure 24:
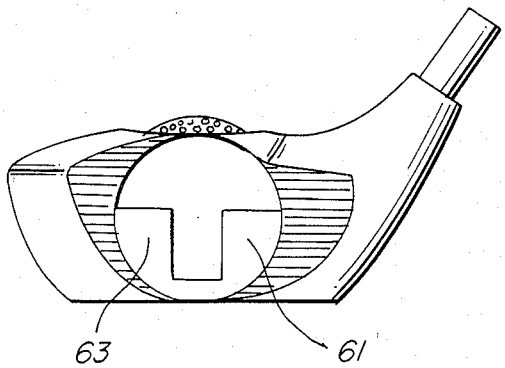
FIG. 24 is a front view of a wood illustrating weighting within the ball section.

FIG. 24 shows the same weighting within the ball section 31 of a typical wood 37 in the club set. Again the wood 37 employs heel and toe weights 61, 63 within the perimeter of the golf ball section 31.

Figure 2A:
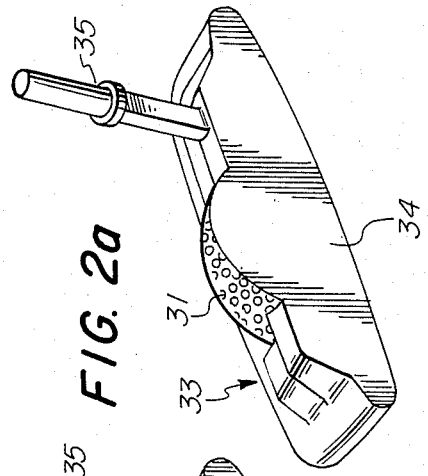
FIG. 2A is a perspective view of an embodiment employing a ¼ ball section.
Figure 2:
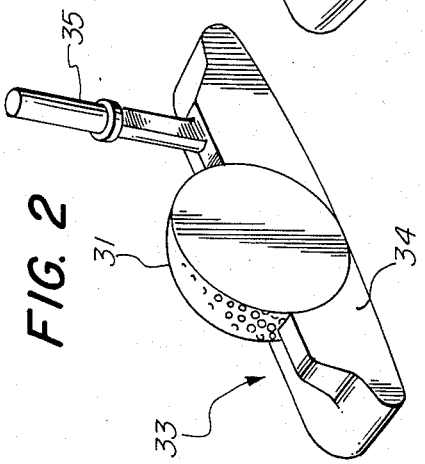
FIG. 2 is a perspective view of a putter according to the preferred embodiment.
Figure 4:
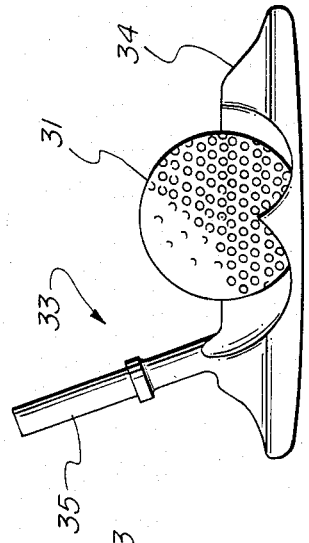
FIG. 4 is a rear elevational view of the putter of FIG. 2.
Figure 3:
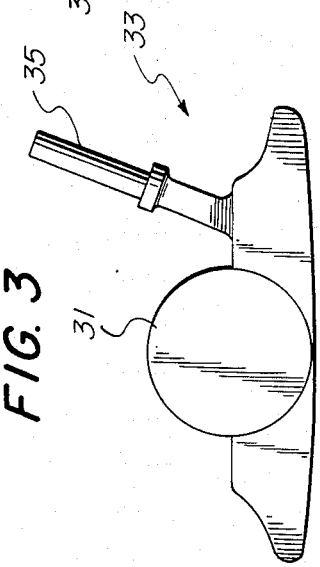
FIG. 3 is a front elevational view of the putter of FIG. 2.
Figure 6:
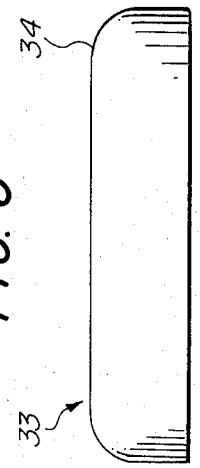
FIG. 6 is a bottom view of the putter of FIG. 2.
Figure 5:
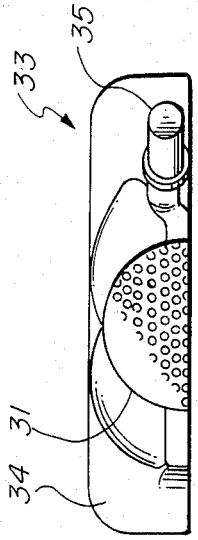
FIG. 5 is a top view of the putter of FIG. 2.
Figure 25:
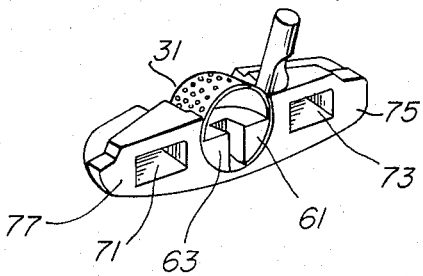
FIG. 25 is a perspective of an alternative putter employing the preferred dual heel-toe weighting system in a putter of different design or "look".

FIG. 25 is an alternate embodiment of a putter which employs the preferred dual heel-toe weighting system in a putter of different design or "look". As shown, heel and toe weights 61, 63 are provided within the ball section 31. Additional heel and toe weights 75, 77 are formed at either end of the putter blade 34. The opening in the ball section 31 and hollow areas 71, 73 are again closed by face plate members (not shown) as in FIG. 21. The weighting system of FIGS. 21 and 25 may also be used with ¼ ball section as shown in FIG. 2A.

The preferred embodiment may be made according to well-known sandcasting or die casting techniques. For example, according to a sand casting technique, a rubber or aluminum mold is to form a wax replica of the finished product, in this case, for example, the putter 33 without the face plates 79, 81, 83 attached. The putter 33 including weights 61, 63, 75, 77 and ball section 31 may thus be formed as an integral unit in one molding step. Once the wax mold is made, it is used to make a ceramic mold by coating the wax mold with a slurry. The wax is melted out to leave a ceramic mold which can stand high temperatures, e.g. 3,000 degrees Fahrenheit. Metal is then pured into the ceramic mold to form the putter 33, and the ceramic mold is thereafter broken off. The face plates 79, 83, 83 are then attached to the ball section 31 utilizing a high strength epoxy such as Golf Smith A&B Shafting epoxy (2000 lb. strength). The same approach is applicable to make putters, irons, and woods according to the preferred embodiment.

It should be noted that the wood of FIGS. 14–20 and 24 may be fabricated other than as an integral cast unit with an epoxied face. The particular recessed ball feature can be employed with a "wood" having a wooden head and recessed plastic or metal ball 31 epoxied or otherwise attached in the recess 51. Appropriate ball section weighting can also be provided as described in connection with FIG. 24 within a hollowed out area of the wooden head.

Figure 10:
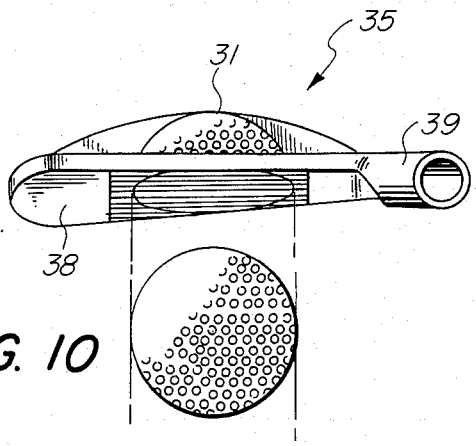
FIG. 10 is a top view of the iron of FIG. 7.
Figure 11:
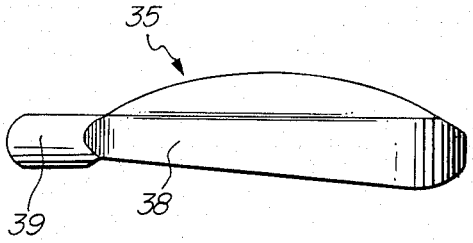
FIG. 11 is a bottom view of the iron of FIG. 7.
Figure 12:
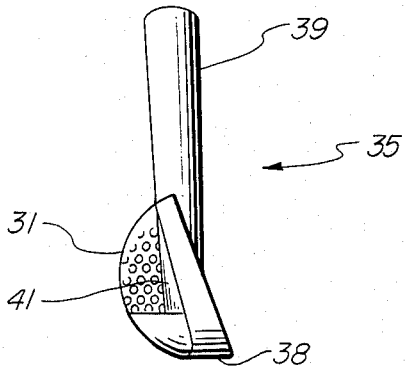
FIG. 12 is a side elevational view of the iron of FIG. 7.
Figure 13:
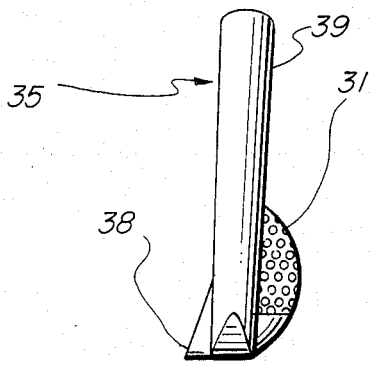
FIG. 13 is a side elevational view of the iron of FIG. 7.
Figure 14:
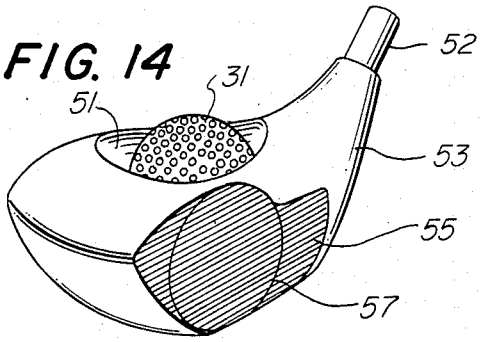
FIG. 14 is a perspective view of a driver according to the preferred embodiment.
Figure 15:
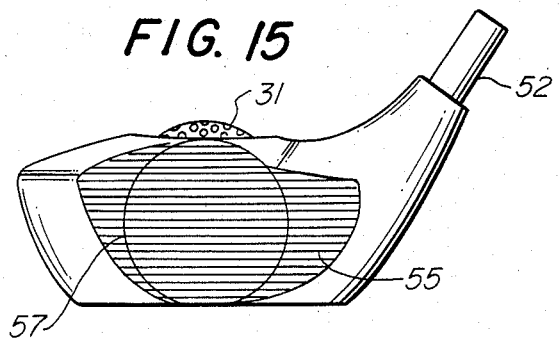
FIG. 15 is a front elevational view of the driver of FIG. 14.
Figure 16:
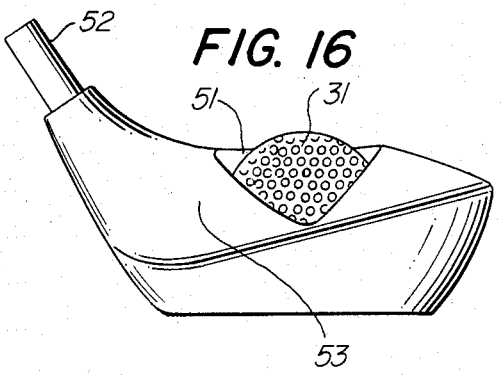
FIG. 16 is a rear elevational view of the driver of FIG. 14.
Figure 17:
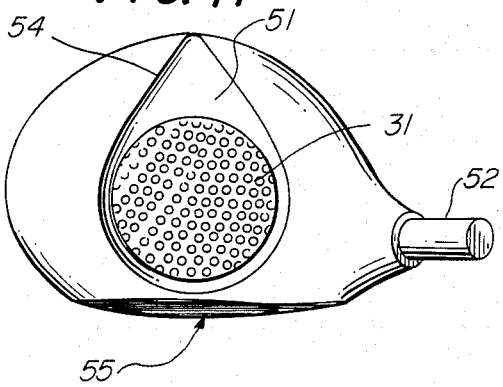
FIG. 17 is a top view of the driver of FIG. 14.
Figure 18:
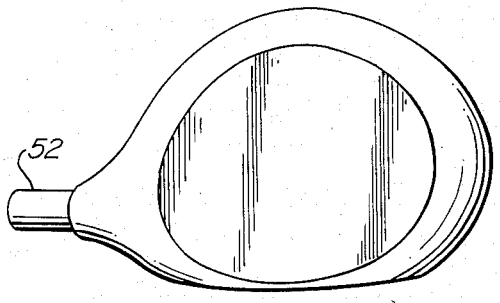
FIG. 18 is a bottom view of the driver of FIG. 14.
Figure 19:
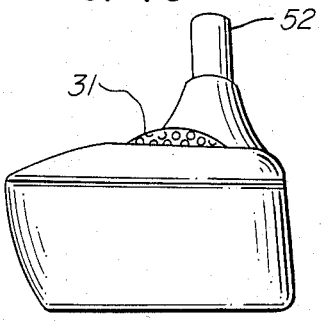
FIG. 19 is a side elevational view of the driver of FIG. 14.
Figure 20:
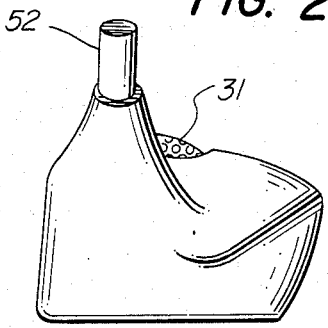
FIG. 20 is a side elevational view of the driver of FIG. 14.

In using the preferred embodiment, the player visually aligns the outer contour of the ball section 31 with the outer contour of the ball 49 and completes his swing. Such alignment with respect to an iron 35 is shown in FIG. 10. Alignment of the woods 37 and putter 33 is according to the same visual alignment procedure.

The preferred embodiment also includes the ability to alter the center of gravity; either high or low on the club face. Many golfers are not able to get the ball airborne. This problem can be cured in some cases by lowering the center of gravity within the club sweetspot. Lowering the center of gravity will facilitate a higher trajectory shot. Conversely, this principle would be applicable to an individual that hits the ball high. The center of gravity would be raised above its standard position. This would invariably lower the ball flight trajectory.

Those skilled in the art will appreciate that diverse applications and modifications of the embodiments disclosed above may be made without departing from the scope and spirit of the invention. Therefore, it is to be understood that, within the scope of the appended claims, the invention may be practiced other than as specifically described herein.

What is claimed is:

1. A golf club set comprising:

at least one putter;

a plurality of irons;

at least one wood;

the heads of said irons, wood each including alignment means for aligning each club of said club set with a golf ball, all of said alignment means being similar in appearance and comprising a substantial section of a sphere the size of a golf ball forming part of each club head of the club set.

2. The golf club set of claim 1 wherein each club of said club set further includes a common weighting structure.

3. The golf club set of claim 1 wherein the alignment means comprises a ball section for each club of the club set.

4. The golf club set of claim 1 wherein each said section is hollow in part and contains weighting means for each said club.

5. The golf club set of claim 4 wherein said weighting means comprises a first heel weight and first toe weight spaced apart from one another within said section.

6. The golf club set of claim 5 wherein said heel and toe weights are separated by a space having a substantially rectangular cross section and are of a height less than the diameter of said spherical ball.

7. The golf club set of claim 6 wherein said at least one putter further includes a second heel weight and a second toe weight at either end of the putter blade.

8. The golf club set of claim 7 wherein said ball section is centrally located on said putter blade and wherein said at least one putter further includes first and second hollow openings in said putter blade on either side of said section.

9. The golf club set of claim 8 wherein each said section is closed by a face plate within which said first heel weight and first toe weight are disposed.

10. The golf club set of claim 9 wherein said first and second hollow openings are each closed by a face plate.

11. The golf club set of claim 1 wherein the section forming part of said putter is a half ball section, wherein the section forming part of each iron is a half ball section disposed behind the iron blade, and wherein the section forming part of each wood is a half ball section recessed in the top surface of each wood.

12. A golf club set comprising:

at least one putter having a putter blade;

a plurality of irons, each having a blade face for striking a golf ball;

at least one wood;

the putter having a substantially hemispherical ball section simulating a golf ball mounted on the putter blade;

each of the plurality of irons having a hemispherical ball section simulating a golf ball mounted behind the blade of the respective iron;

said at least one wood having a recess in the top surface thereof, said recess having mounted a hemispherical ball section at least partially therein;

each said hemispherical ball section containing a heel weight and a toe weight, the heel and toe weights being formed as mirror images spaced apart from one another, the shape of the space between the two weights being substantially rectangular in cross section and selected to determine the weight of the respective heel and toe weights, each heel and toe weight having a top surface disposed such that a space comprising a quarter sphere lies above said heel and toe weights.

* * * * *